US011585595B2

(12) United States Patent
Nakajima et al.

(10) Patent No.: US 11,585,595 B2
(45) Date of Patent: Feb. 21, 2023

(54) REFRIGERATOR

(71) Applicant: Samsung Electronics Co., Ltd., Suwon-si (KR)

(72) Inventors: Hideki Nakajima, Yokohama (JP); Hiroyuki Tanaka, Yokohama (JP); Takashi Yoshikawa, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/358,801

(22) Filed: Jun. 25, 2021

(65) Prior Publication Data

US 2022/0018595 A1 Jan. 20, 2022

(30) Foreign Application Priority Data

Jul. 14, 2020 (JP) ..... JP2020-120907
Mar. 25, 2021 (KR) ..... 10-2021-0038420

(51) Int. Cl.
*F25D 25/02* (2006.01)
*A47B 88/90* (2017.01)

(52) U.S. Cl.
CPC ..... *F25D 25/025* (2013.01); *A47B 88/90* (2017.01); *A47B 2088/901* (2017.01)

(58) Field of Classification Search
CPC ..... F25D 25/005; F25D 25/025; F25D 25/04; F25D 25/022; F25D 23/021; A47B 88/90; A47B 2088/901; A47B 2088/0081
See application file for complete search history.

(56) References Cited

U.S. PATENT DOCUMENTS 7,396,093 B2 7/2008 Jeong et al.
7,628,461 B2 12/2009 Carden et al.
8,231,190 B2 * 7/2012 Ertz ..... F25D 25/025 312/402
8,827,390 B2 * 9/2014 Wehner ..... F25D 23/028 312/405.1
9,377,238 B2 * 6/2016 Hall ..... F25D 25/025
9,389,014 B2 * 7/2016 Rehage ..... F25D 25/025
(Continued)

FOREIGN PATENT DOCUMENTS

CN 111649529 B 12/2021
EP 1621838 B1 12/2014
(Continued)

OTHER PUBLICATIONS

International Search Report dated Oct. 22, 2021, issued in International Patent Application No. PCT/KR2021/008058.

*Primary Examiner* — Andrew M Roersma
(74) *Attorney, Agent, or Firm* — Jefferson IP Law, LLP

(57) ABSTRACT

A refrigerator is provided. The refrigerator includes a storeroom lifted when the storeroom is pulled out and giving a degree of freedom to a lifting method. The refrigerator includes a main body, a door arranged to be pulled out from the main body, a storeroom arranged to be pulled out from the main body along with the door, and a lift device arranged to lift or lower the storeroom in connection with pulling-out or pushing-in of the door, wherein the lift device includes a guide including a portion sloping upward or downward in a pull-out direction of the storeroom, and a guidee guided by the guide so that the storeroom is lifted when the guidee is moved along the guide.

17 Claims, 10 Drawing Sheets

(56) References Cited

U.S. PATENT DOCUMENTS

| | | | | |
|---|---|---|---|---|
| 10,465,970 | B1 * | 11/2019 | Kang | F25D 25/025 |
| 10,690,401 | B2 | 6/2020 | Yang et al. | |
| 11,378,330 | B2 | 7/2022 | Choi | |

FOREIGN PATENT DOCUMENTS

| | | | | | |
|---|---|---|---|---|---|
| EP | 4 023 966 | A1 | | 7/2022 | |
| JP | 6-245829 | A | | 9/1994 | |
| JP | 2005-087365 | A | | 4/2005 | |
| JP | 2010-183984 | A | | 8/2010 | |
| JP | 2020-34203 | A | | 3/2020 | |
| KR | 10-0564412 | B1 | | 3/2006 | |
| KR | 10-0690647 | B1 | | 3/2007 | |
| KR | 20080043150 | A | * | 5/2008 | F25D 25/025 |
| KR | 20080101334 | A | * | 11/2008 | F25D 25/025 |
| KR | 20100109466 | A | * | 10/2010 | A47B 77/16 |
| KR | 10-2017-0140010 | A | | 12/2017 | |
| KR | 10-2020-0066875 | A | | 6/2020 | |

* cited by examiner

REFRIGERATOR

CROSS-REFERENCE TO RELATED APPLICATION(S)

This application is based on and claims priority under 35 U.S.C. § 119(a) of a Japanese patent application number 2020-120907, filed on Jul. 14, 2020, in the Japanese Intellectual Property Office, and of a Korean patent application number 10-2021-0038420, filed on Mar. 25, 2021, in the Korean Intellectual Property Office, the disclosures of each of which is incorporated by reference herein in its entirety.

BACKGROUND

1. Field

The disclosure relates to a refrigerator.

2. Description of Related Art

Of the types of traditional refrigerators, there is a refrigerator configured to have a storeroom lifted in connection with pull-out of a door of the refrigerator when the door is pulled out forward from the main body of the refrigerator as disclosed in Patent Document 1.

In the disclosure, the refrigerator has the storeroom lifted by extending or contracting an X link in connection with slide motion of the door. This makes the user conveniently take out an item stored in the storeroom without bending his/her back as the storeroom is lifted when the door is pulled out.

However, in this structure of lifting the storeroom using the X link, it is difficult to give a degree of freedom to the method of lifting the storeroom. For example, the weight felt by the user while the user is lifting the storeroom is unchanged until the storeroom is lifted to the end, and a lifting speed of the storeroom is also unchanged unless the user makes a change in force when pulling out the door. Hence, the structure is not deemed good because a degree of freedom is hardly given to the method of lifting the storeroom.

The above information is presented as background information only to assist with an understanding of the disclosure. No determination has been made, and no assertion is made, as to whether any of the above might be applicable as prior art with regard to the disclosure.

RELATED ART DOCUMENT

Patent Document

PATENT DOCUMENT 1: JP patent publication No. 1994-245829.

SUMMARY

Aspects of the disclosure are to address at least the above-mentioned problems and/or disadvantages and to provide at least the advantages described below. Accordingly, an aspect of the disclosure is to provide a refrigerator having a storeroom lifted while the storeroom is pulled out, and giving a degree of freedom to a way of lifting the storeroom.

Additional aspects will be set forth in part in the description which follows and, in part, will be apparent from the description, or may be learned by practice of the presented embodiments.

In accordance with an aspect of the disclosure, a refrigerator is provided. The refrigerator includes a main body, a door arranged to be pulled out from the main body, a storeroom arranged to be pulled out from the main body along with the door, and a lift device arranged to lift or lower the storeroom in connection with pulling-out or pushing-in of the door, wherein the lift device may include a guide having a portion sloping upward or downward in a pull-out direction of the storeroom, and a guidee guided by the guide so that the storeroom is lifted when the guidee is moved along the guide.

The refrigerator may further include a slide device including the storeroom and a supporting frame supporting the storeroom and lifted or lowered along with the storeroom.

The guide may be arranged in the slide device or the main body.

The guidee may be arranged in the main body or the slide device.

The guide may include a starting end at which the guidee is placed when the storeroom is in a closed state in which the storeroom is received in the main body, an ending end at which the guidee is placed when the storeroom is in an open state in which the storeroom is pulled out from the main body, and a slope portion slantingly extending between the starting end and the ending end.

The starting end may extend horizontally to the slope portion.

The ending end may extend horizontally to the slope portion.

The slope portion may slantingly extend upward or downward in the pull-out direction of the storeroom.

The slope portion may be curved with gradually changing slope angles.

The guide may include a groove extending from the starting end to the ending end.

The guidee may be arranged to slide within the groove.

The slide device may further include an X link for preventing the storeroom from swaying forward or backward when the storeroom is being lifted.

The refrigerator may further include an arm member arranged to be pulled out from the main body along with the storeroom and sliding and turning when being pulled out from the main body.

The arm member may be arranged to turn to lift the storeroom.

The arm member may include an effort portion to which the guidee is coupled to make relative rotation, a load portion coupled to the storeroom to make relative rotation to convey force applied on the effort portion to the storeroom, and a fulcrum portion located between the effort portion and the load portion to serve as a center of rotation of the arm member.

A distance from the effort portion to the fulcrum portion may be longer than a distance from the load portion to the fulcrum portion.

The refrigerator may further include an X link for assisting the storeroom to be lifted by preventing the storeroom from swaying forward or backward.

The load portion may be connected to a crossing point of the X link.

The arm member may further include a slit for allowing the load portion to slide.

The storeroom may further include a slit connected to the load portion.

The load portion may be formed to be able to slide within the slit.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features and advantages of certain embodiments of the disclosure will be more apparent from the following description taken in conjunction with the accompanying drawings, in which.

Throughout the drawings, like reference numerals will be understood to refer to like parts, components, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

A refrigerator according to an embodiment of the disclosure will now be described in detail with reference to accompanying drawings.

Figure 1:
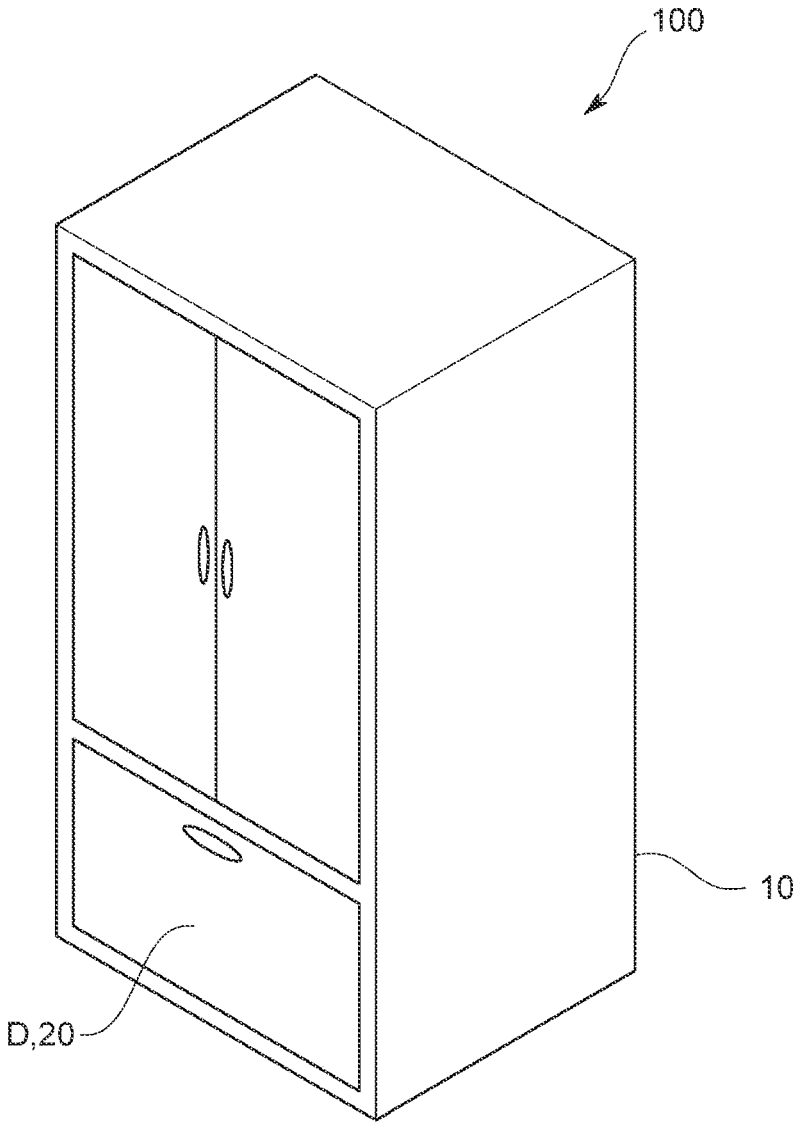
FIG. 1 is a perspective view of a refrigerator, according to an embodiment of the disclosure.

FIG. 1 is a perspective view of a refrigerator, according to an embodiment of the disclosure.

Referring to FIG. 1, a refrigerator 100 may include a drawer-type door D. The refrigerator 100 may be configured to have a storeroom R at the bottom pulled out by pulling out the drawer-type door D. Positions of the drawer-type door D and the storeroom R of FIGS. 2 to 4, at the bottom may be changed.

Figure 2:
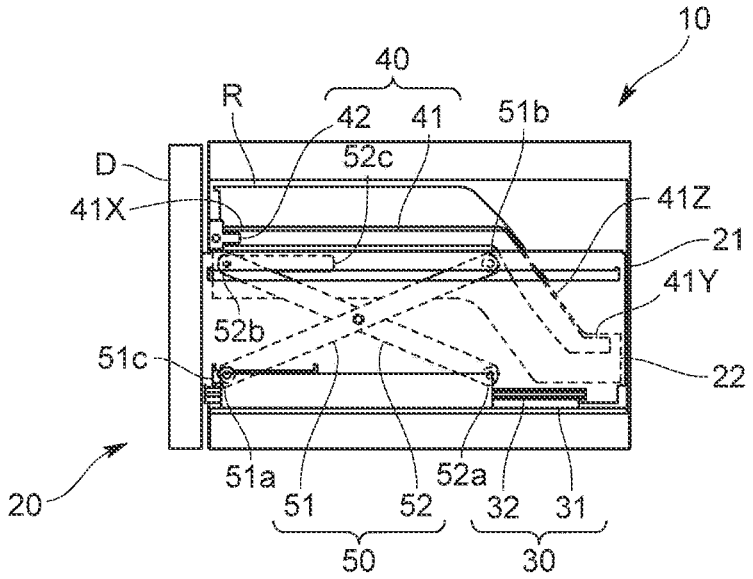
FIG. 2 is a cross-sectional view illustrating inside features of a refrigerator in a state in which a slide device is closed, according to an embodiment of the disclosure.
Figure 3:
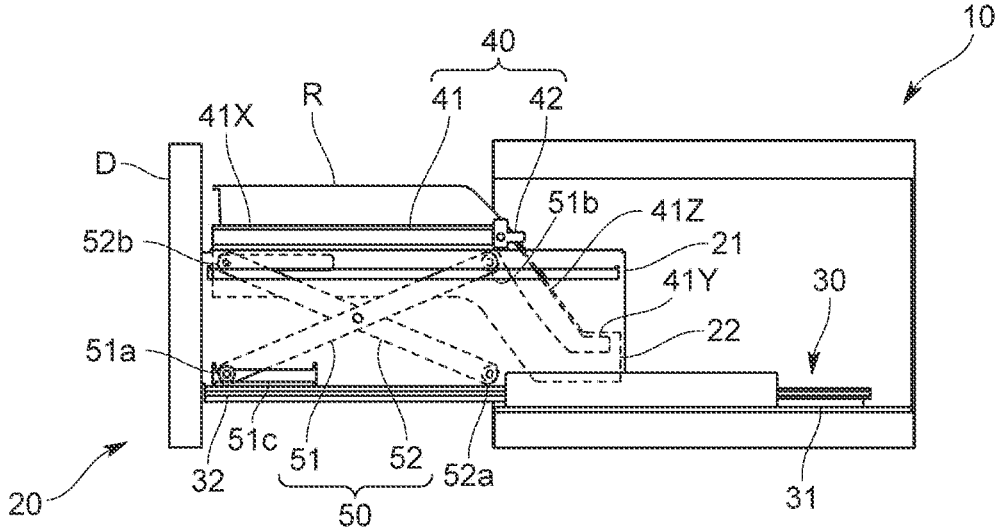
FIG. 3 is a cross-sectional view illustrating inside features of a refrigerator in a state in which a slide device is on the way of being pulled out, according to an embodiment of the disclosure.
Figure 4:
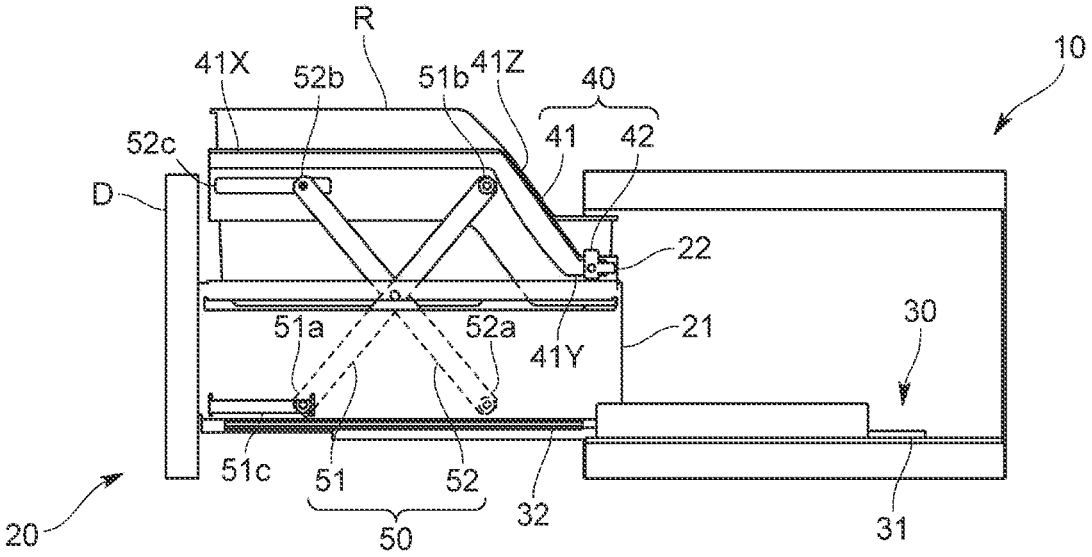
FIG. 4 is a cross-sectional view illustrating inside features of a refrigerator in a state in which a slide device is pulled out, according to an embodiment of the disclosure.

Specifically, the refrigerator 100 may include a main body 10 and a slide device 20 to be pulled out from the main body 10, as shown in FIGS. 2 to 4, and the slide device 20 may be comprised of the aforementioned drawer-type door D and a storeroom R.

FIG. 2 is a cross-sectional view illustrating inside features of a refrigerator in a state in which a slide device is closed, according to an embodiment of the disclosure.

FIG. 3 is a cross-sectional view illustrating inside features of a refrigerator in a state in which a slide device is on the way of being pulled out, according to an embodiment of the disclosure.

FIG. 4 is a cross-sectional view illustrating inside features of a refrigerator in a state in which a slide device is pulled out, according to an embodiment of the disclosure.

Referring to FIGS. 2 to 4, a slide unit 30 may be arranged between the main body 10 and the slide device 20 to support the slide device 20 to be slidable against the main body 10. In an embodiment of the disclosure, the slide unit 30 may include a slide rail 31 arranged on one side of the main body 10 or the slide device 20, and a slider 32 arranged on the other side of the main body 10 or the slide device 20 to slide on the slide rail 31.

In an embodiment of the disclosure, the refrigerator 100 may have a structure in which the storeroom R is lifted when the slide device 20 is pulled out. In other words, when the user pulls out the slide device 20, the storeroom R may be lifted in connection with the pull-out of the slide device 20. The slide device 20 may further include a lift device 40 arranged between the main body 10 and the storeroom R to lift or lower the storeroom R in connection with pulling-out or pushing-in of the slide device 20.

As shown in FIGS. 2 to 4, the lift device 40 may include a guide 41 arranged in one of the main body 10 and the slide device 20 and a guidee 42 arranged in the other one of the main body 10 and the slide device 20. That is, when the guide 41 is arranged in the main body 10, the guidee 42 may be arranged in the slide device 20, and when the guide 41 is arranged in the slide device 20, the guidee 42 may be arranged in the main body 10.

In a closed state in which the slide device 20 is received in the main body 10 (referring to FIG. 2), the guidee 42 may be located at a starting end 41X of the guide 41, and in an open state in which the slide device 20 is pulled out from the main body 10 (referring to FIG. 4), the guidee 42 may be located at an ending end 41Y of the guide 41.

In an embodiment of the disclosure, the guide 41 may be arranged in the slide device 20, in which case, specifically, the guide 41 may have the form of grooves formed on outer left and right surfaces of the slide device 20. More specifically, in an embodiment of the disclosure, the slide device 20 may further include an outer frame 21 to be pulled out along with the drawer-type door D without being lifted, and a supporting frame 22 lifted along with the storeroom R while supporting the storeroom R.

In an embodiment of the disclosure, the guide 41 may be arranged on an outer surface of the supporting frame 22. The guide 41 may be formed to slope downward or upward in a direction in which the slide device 20 is pulled out (pull-out direction). Specifically, at least a portion from the starting end 41X to the ending end 41Y may be formed to slope upward from back to front. The at least a portion between the starting end 41X and the ending end 41Y will now be called a slope portion 41Z. Furthermore, a direction from back to front is called a pull-out direction. The slope portion 41Z may be formed to slope upward in the pull-out direction. For example, the slope portion 41Z may slope at an angle of about 10° to 60°, and may extend straight between the starting end 41X and the ending end 41Y.

A portion of the guide 41 on the starting end 41X side and a portion of the guide on the ending end 41Y side may extend in the horizontal direction. A portion of the guide 41 from the starting end 41X to the slope portion 41Z may extend in the horizontal direction. Similarly, a portion of the guide 41 from the ending end 41Y to the slope portion 41Z may extend in the horizontal direction. The portion on the starting end 41X side refers to the portion from the starting end 41X to an end of the slope portion 41Z, and the portion on the ending end 41Y side refers to the portion from the ending end 41Y to the other end of the slope portion 41Z.

In an embodiment of the disclosure, horizontal length of the slope portion 41Z of the guide 41 is shorter than the length of the portion of the guide 41 on the starting end 41X side. That is, the horizontal length of the slope portion 41Z is shorter than horizontal length from the starting end 41X to the one end of the slope portion 41Z.

In an embodiment of the disclosure, the guidee 42 may be arranged in the main body 10. In an embodiment of the disclosure, the guidee 42 may include rollers (not shown) arranged on inner left and right surfaces of the main body 10. Specifically, the guidee 42 may be fixed onto the inner surface of the main body 10 and arranged to be moved relative to the guide 41.

With this mechanism, when the drawer-type door D that has been closed is pulled out, the slide device 20 is pulled out from the main body 10 and at the same time, the guidee 42 is guided to the ending end 41Y from the starting end 41X of the guide 41. In this case, the guidee 42 slides on the slope portion 41Z of the guide 41 so that the storeroom R is lifted from the supporting frame 22. This movement is shown in FIGS. 2 and 3.

When the drawer-type door D that has been open is pulled in, the slide device 20 is pulled into the main body 10 and at the same time, the guidee 42 is guided to the starting end 41X from the ending end 41Y of the guide 41. In this case, the guidee 42 slides on the slope portion 41Z of the guide 41 so that the storeroom R falls to the supporting frame 22. The storeroom R that has fallen to the supporting frame 22 is received in the main body 10. This motion is shown from FIG. 4 to FIG. 2.

While the storeroom R is on the way of being lifted or falling, when there is only the guidee 42 to support weight of the storeroom R or stored items, the storeroom R is swayed unless the guidee 42 is located right under or right above the center of the storeroom R.

To prevent this, the slide device 20 according to an embodiment of the disclosure may further include an auxiliary link 50 to assist the storeroom R to be lifted or lowered by the lift device 40, as shown in FIGS. 2 to 4.

Specifically, the auxiliary link 50 is an X link 50 arranged between the outer frame 21 and the supporting frame 22, including a first link member 51 and a second link member 52 crossly connected to each other and arranged to be rotated together.

Lower ends 51*a* and 52*a* of the first and second link members 51 and 52 may be coupled to the outer frame 21, and upper ends 51*b* and 52*b* of the first and second link members 51 and 52 may be coupled to the supporting frame 22.

Specifically, the upper end 51*b* of the first link member 51 may be fixed to the supporting frame 22. Furthermore, a roller (not shown) may be arranged at the lower end 51*a* of the first link member 51, and the roller may slide within a slide groove 51*c* arranged on the outer frame 21 to extend to the front and the back.

The lower end 52*a* of the second link member 52 may be fixed to the outer frame 21. A roller (not shown) may be arranged at the upper end 52*b* of the second link member 52, and the roller may slide within a slide groove 52*c* arranged on the supporting frame 22 to extend to the front and the back.

With this mechanism, when the drawer-type door D that has been closed is pulled out, the guidee 42 slides along the slope portion 41Z of the guide 41 so that the storeroom R may be lifted from the supporting frame 22, as described above. Furthermore, in connection with this motion, the X link 50 may extend in the vertical direction while supporting the weight of the storeroom R. Accordingly, lifting the storeroom R by the lift device 40 is assisted by the X link 50.

When the drawer-type door D that has been open is pulled in, the guidee 42 slides along the slope portion 41Z of the guide 41 so that the storeroom R may fall to the supporting frame 22, as described above. Furthermore, in connection with this motion, the X link 50 may contract in the vertical direction while supporting the weight of the storeroom R. Accordingly, lowering the storeroom R by the lift device 40 is assisted by the X link 50.

Technical effects of the refrigerator 100 according to the embodiment of the disclosure will now be described.

According to the refrigerator 100 in the embodiment of the disclosure, the guide 41 slopes downward or upward in the pull-out direction of the slid device 20, so the weight or speed of lifting the storeroom R felt by the user while the storeroom R is lifted may be changed by changing how the guide 41 slopes in the pull-out direction of the slide device 20. Accordingly, a degree of freedom may be given to how the storeroom R is lifted.

Furthermore, as the ending end 41Y side of the guide 41 extends in the horizontal direction, the storeroom R is prevented from automatically falling down even though the user takes off his/her hand from the slide device 20 in the open state in which the guidee 42 is located at the ending end 41Y of the guide 41, thereby facilitating an increase in safety and convenience. As mentioned above, the ending end 41Y side refers to the portion from the ending end 41Y to the other end of the slope portion 41Z.

Moreover, as the starting end 41X side of the guide 41 extends in the horizontal direction, when the drawer-type door D is pulled out from the closed state in which the guidee 42 is located at the starting end 41X of the guide 41, there is no need to apply force to lift the storeroom R and the storeroom R may not be caught by a side of the main body 10 because the storeroom R is lifted right away. This may further increase safety or convenience of the refrigerator 100.

In addition, as the slide device 20 includes the X link 50 that assists the storeroom R to be lifted or fall, the storeroom R may be prevented from being swayed forward or backward. Accordingly, the storeroom R may be lifted or lowered while maintaining its horizontal position.

A refrigerator according to another embodiment of the disclosure will now be described in detail with reference to accompanying drawings. Description of the same features as in the previous embodiment of the disclosure will not be repeated.

As described above in the previous embodiment of the disclosure, the storeroom R is lifted by the lift device 40 when the guidee 42 slides along the slope portion 41Z of the guide 41. In the previous embodiment of the disclosure, the horizontal length of the slope portion 41Z of the guide 41 is shorter than the length of the starting end 41X side of the guide 41, so the storeroom R needs to be lifted with relatively small amount of pull-out (amount of stroke). As a result, the user needs to lift the storeroom R rapidly and thus, the force applied (or load imposed) by the user to lift the storeroom R relatively increases and the weight felt by the user increases while the storeroom R is lifted.

Hence, this embodiment of the disclosure aims to provide the refrigerator 100 that requires less force (load) to lift the storeroom R than in the previous embodiment of the disclosure.

Figure 5:
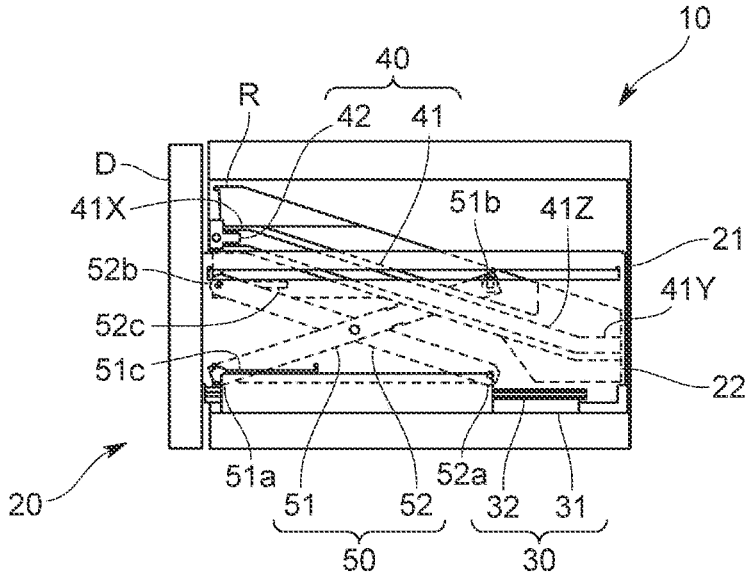
FIG. 5 is a cross-sectional view illustrating inside features of a refrigerator in a state in which a slide device is closed, according to an embodiment of the disclosure.

FIG. 5 is a cross-sectional view illustrating inside features of a refrigerator in a state in which a slide device is closed, according to another embodiment of the disclosure.

Figure 6:
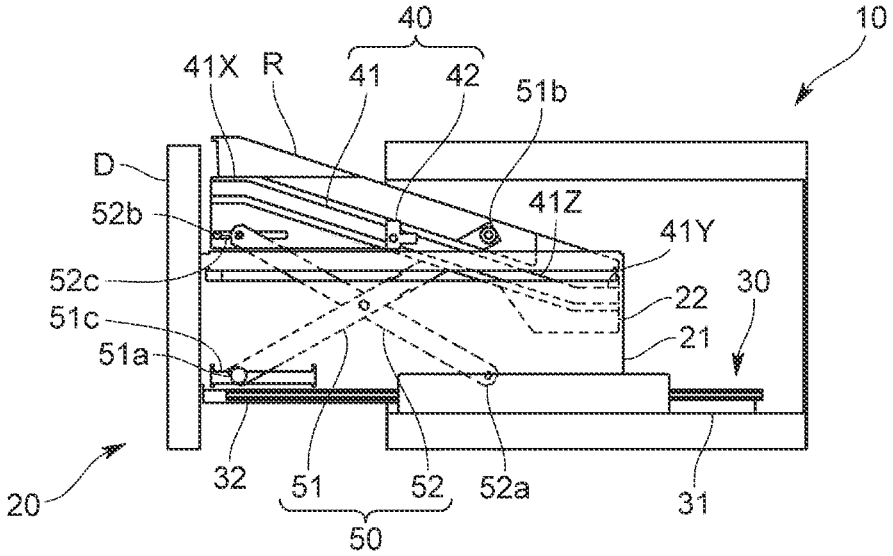
FIG. 6 is a cross-sectional view illustrating inside features of a refrigerator in a state in which a slide device is on the way of being pulled out, according to an embodiment of the disclosure.

FIG. 6 is a cross-sectional view illustrating inside features of a refrigerator in a state in which a slide device is on the way of being pulled out, according to another embodiment of the disclosure.

Figure 7:
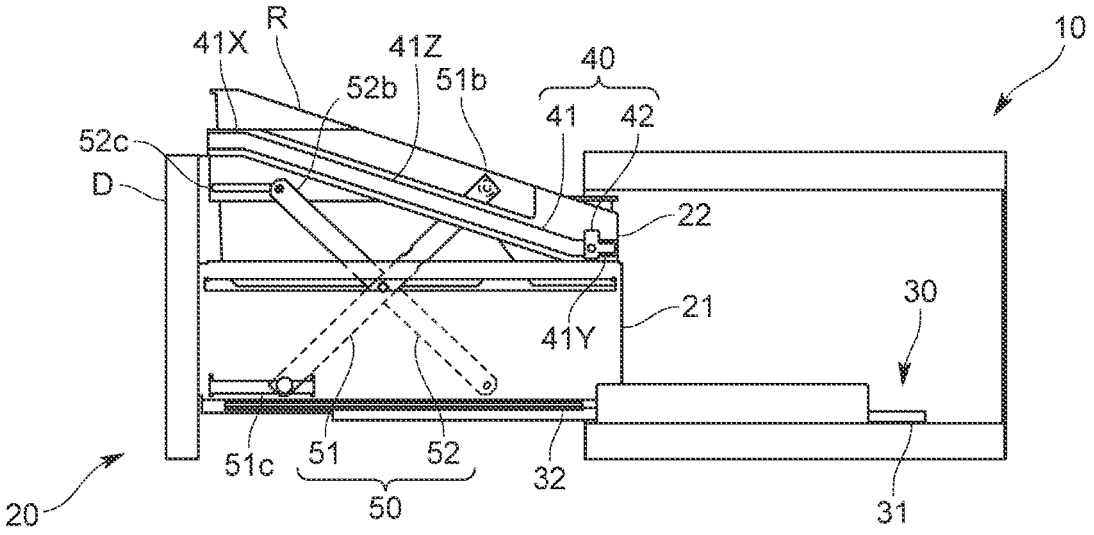
FIG. 7 is a cross-sectional view illustrating inside features of a refrigerator in a state in which a slide device is pulled out, according to an embodiment of the disclosure.

FIG. 7 is a cross-sectional view illustrating inside features of a refrigerator in a state in which a slide device is pulled out, according to another embodiment of the disclosure.

In this embodiment of the disclosure, the refrigerator 100 has the horizontal length of the slope portion 41Z of the guide 41 longer than the length of the starting end 41X side.

Referring to FIGS. 5 to 7, the horizontal length of the slope portion 41Z is longer than the length from the starting end 41X to an end of the slope portion 41Z. Furthermore, the horizontal length of the slope portion 41Z of the guide 41 is longer than the length of the ending end 41Y side. That is, the horizontal length of the slope portion 41Z is longer than the length from the ending end 41Y to the other end of the slope portion 41Z.

Technical effects of the refrigerator 100 according to the embodiment of the disclosure will now be described.

The refrigerator 100 in this embodiment of the disclosure may allow the storeroom R to be lifted with relatively long pull-out (stroke), thereby enabling the force (load) required to lift the storeroom R to be distributed within the relatively long stroke. As a result, the user may lift the storeroom R not rapidly but slowly, so the weight felt by the user may become less while the storeroom R is lifted.

A refrigerator according to another embodiment of the disclosure will now be described in detail with reference to accompanying drawings. Description of the same features as in the previous embodiments of the disclosure will not be repeated.

This embodiment of the disclosure aims to provide the refrigerator 100 that requires less force (load) to lift the storeroom R than in the previous embodiments of the disclosure.

Figure 8:
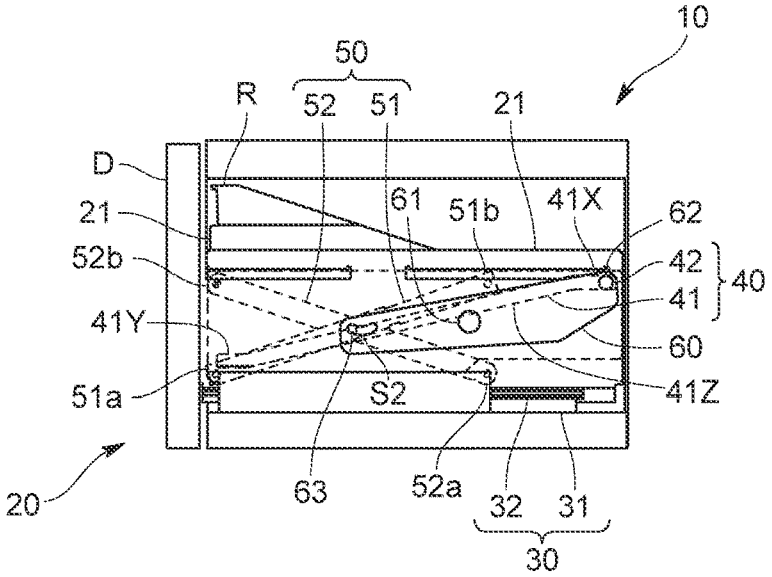
FIG. 8 is a cross-sectional view illustrating inside features of a refrigerator in a state in which a slide device is closed, according to an embodiment of the disclosure.

FIG. 8 is a cross-sectional view illustrating inside features of a refrigerator in a state in which a slide device is closed, according to another embodiment of the disclosure.

Figure 9:
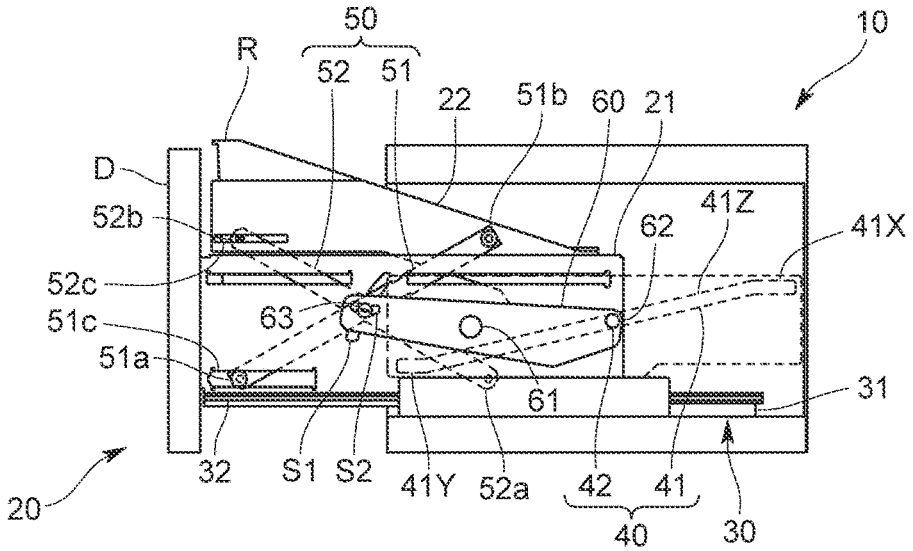
FIG. 9 is a cross-sectional view illustrating inside features of a refrigerator in a state in which a slide device is on the way of being pulled out, according to an embodiment of the disclosure.

FIG. 9 is a cross-sectional view illustrating inside features of a refrigerator in a state in which a slide device is on the way of being pulled out, according to another embodiment of the disclosure.

Figure 10:
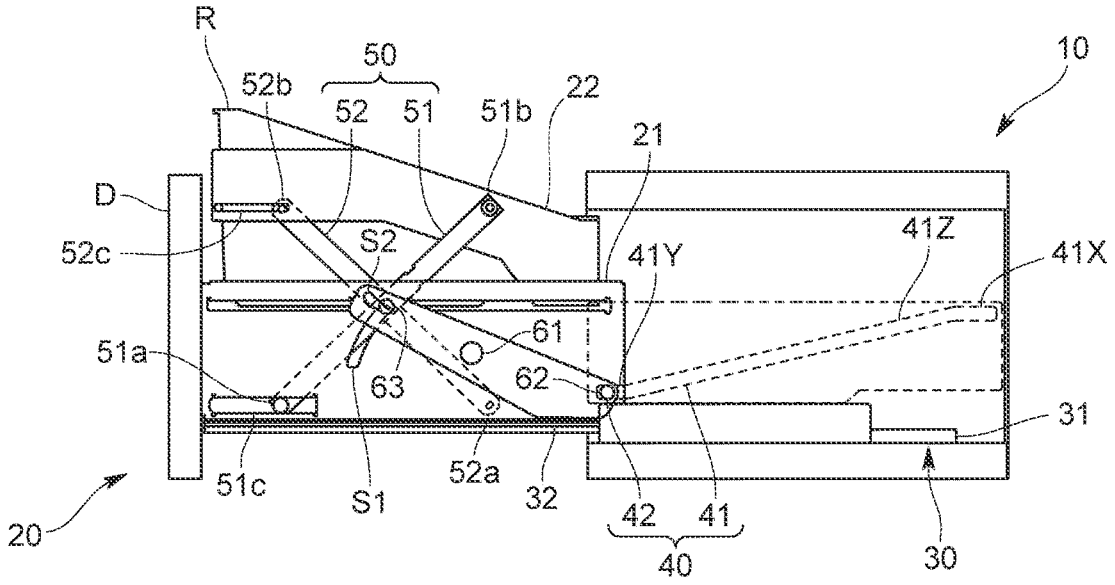
FIG. 10 is a cross-sectional view illustrating inside features of a refrigerator in a state in which a slide device is pulled out, according to an embodiment of the disclosure.

FIG. 10 is a cross-sectional view illustrating inside features of a refrigerator in a state in which a slide device is pulled out, according to another embodiment of the disclosure.

Referring to FIGS. 8 to 10, the lift device 40 according to this embodiment of the disclosure, unlike the previous embodiments of the disclosure, may have the guide 41 arranged in the main body 10 and the guidee 42 arranged in the slide device 20.

Specifically, the guide 41 may include grooves formed on inner left and right surfaces of the main body 10. The guide 41 may include the slope portion 41Z that slopes in the pull-out direction of the slide device 20. In this embodiment of the disclosure, the slope portion 41Z may be formed to slope downward from back to front. The slope portion 41Z may be formed to slope downward in the pull-out direction and may extend in a straight line.

A portion of the guide 41 on the starting end 41X side and a portion of the guide on the ending end 41Y side may extend in the horizontal direction. The horizontal length of the slope portion 41Z may be longer than the length of the portion on the starting end 41X side and the length of the portion on the ending end 41Y side.

The guidee 42 may include rollers (not shown) arranged on outer left and right surfaces of the slide device 20. Specifically, the guidee 42 may be fixed on the outer left and right surfaces of the supporting frame 22 of the slide device 20 and may be moved relative to the guide 41.

In the embodiment of the disclosure, the refrigerator 100 may have a structure to increase force to pull out the drawer-type door D using the principle of the lever and convert the force to force to lift the storeroom R.

As shown in FIGS. 8 to 10, the refrigerator 100 according to the embodiment of the disclosure may include an arm member 60 that rotates on a fulcrum portion 61 and simultaneously, conveys the force on an effort portion 62 to the storeroom R via the load portion 63. The arm member 60 is characterized as having length from the effort portion 62 to the fulcrum portion 61 longer than the length from the load portion 63 to the fulcrum portion 61.

Specifically, the fulcrum portion 61 is set between front and rear ends of the arm member 60, and through the fulcrum portion 61, the arm member 60 is rotationally supported on the supporting frame 22.

The effort portion 62 is set farther back than the fulcrum portion 61 of the arm member 60 and connected to the guidee 42. Accordingly, the effort portion 62 may be rotated around the fulcrum portion 61 along the guide 41 in connection with sliding motion of the guidee 42.

The effort portion 62 is set farther forward than the fulcrum portion 61 of the arm member 60 and connected to the storeroom R or a member lifted or lowered along with the storeroom R. Accordingly, the load portion 63 may be lifted or may fall along with the storeroom R while rotating around the fulcrum portion 61 according to rotation of the effort portion 62. In this case, a first slit S1 may be formed on the supporting frame 22 to allow rotation of the load portion 63, and the load portion 63 may slide within the first slit S1.

Hence, as a distance from the effort portion 62 to the fulcrum portion 61 is longer than a distance from the load portion 63 to the fulcrum portion 61, action force on the effort portion 62 may be increased to be used as force required to lift the storeroom R.

In the embodiment, the load portion 63 may be coupled to the crossing point between the first link member 51 and the second link member 52 included in the X link 50, and the crossing point may be moved with extension or contraction of the X link 50. A second slit S2 may be formed on the arm member 60 to allow movement of the load portion 63 engaged with the crossing point of the X link 50, and the load portion 63 may slide within the second slit S2.

This may enable the action force on the effort portion 62 to be delivered to the storeroom R from the load portion 63 through the X link 50.

In the embodiment of the disclosure, the load portion 63 may not be necessarily coupled to the crossing point of the X link 50. For example, to support the storeroom R more stably, the load portion 63 may be coupled to an outer surface of the storeroom R right under or right above the center of the storeroom R.

Technical effects of the refrigerator 100 according to the embodiment of the disclosure will now be described.

In this embodiment of the disclosure, as the refrigerator 100 may include the arm member 60 that amplifies force to pull out the drawer-type door D according to the principle of the lever and converts the amplified force to force to lift the storeroom R, the force (load) required to lift the storeroom R is reduced and thus, the weight felt by the user while the storeroom R is lifted may be further reduced.

Other embodiments of the disclosure, which are not shown in the drawings, will now be described.

In the previous embodiments of the disclosure, the slope portion 41Z of the guide 41 extends straight, but the slope portion 41Z may have the form having gradually changing slope angles or may be curved. Specifically, the slope portion 41Z may be formed to connect between the starting end 41X and the ending end 41Y having a height difference therebetween, and the slope portion 41Z may have the form of a curve.

Furthermore, although in the previous embodiments of the disclosure, the storeroom R is supported by the supporting frame 22 and the storeroom R and the supporting frame 22 are separately provided, the storeroom R and the supporting frame 22 may be integrally formed.

Moreover, the refrigerator 100 may have a structure to allow force on the slide device 20 that has been in the closed state in which the slide device 20 is received in the main body 10, to be applied in a direction in which the drawer-type door D is closed.

Specifically, the starting end 41X of the guide 41 may be formed to slope upward from back to front. That is, the starting end 41X may be formed to slope upward in the pull-out direction.

In another embodiment of the disclosure, the refrigerator 100 may include a draw gear to draw the slide device 20 in a direction in which the drawer-type door D is closed, when the guidee 42 reaches the starting end 41X of the guide 41. For example, the draw gear may include a cylinder, a spring, a guide part formed at an angle, a damper, etc.

Furthermore, the refrigerator 100 may include a pull-out assisted device that assists pull-out of the slide device 20 when the slide device 20 that has been in the closed state is pulled out, and a pushed-in assisted device that assists push-in of the slide device 20 that has been in the open sate is pulled in.

For example, the pull-out assisted device and the push-in assisted device may include a bias member such as a spring.

According to the disclosure, a refrigerator having a storeroom lifted while the storeroom is pulled out and having better user convenience by giving a degree of freedom to a way of lifting the storeroom may be provided.

Several embodiments of the disclosure have been described above, but a person of ordinary skill in the art will understand and appreciate that various modifications can be made without departing the scope of the disclosure. Thus, it will be apparent to those ordinary skilled in the art that the true scope of technical protection is only defined by the following claims.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A refrigerator comprising:
- a main body;
- a door arranged to be pulled out from the main body;
- a storeroom arranged to be pulled out from the main body along with the door;
- a slide device comprising:
  - the storeroom, and
  - a supporting frame supporting the storeroom and lifted or lowered along with the storeroom;
- a lift device configured to guide a vertical direction movement of the storeroom with respect to the door in connection with a horizontal movement of the door, wherein the lift device comprises:
  - a guide comprising a portion sloping upward or downward in a pull-out direction of the storeroom, and
  - a guidee guided by the guide so that the storeroom is lifted when the guidee is moved along the guide; and
- an arm member, the arm member comprising:
  - an effort portion to which the guidee is coupled to make relative rotation,
  - a load portion coupled to the storeroom to make relative rotation and convey force applied on the effort portion to the storeroom, and
  - a fulcrum portion located between the effort portion and the load portion to serve as a center of rotation of the arm member.

2. The refrigerator of claim 1,
- wherein the guide is arranged in the slide device or the main body, and
- wherein the guidee is arranged in the main body or the slide device.

3. The refrigerator of claim 1, wherein the guide comprises:
- a starting end at which the guidee is located when the storeroom is in a closed state in which the storeroom is received in the main body,
- an ending end at which the guidee is located when the storeroom is in an open state in which the storeroom is pulled out from the main body, and
- a slope portion slantingly extending between the starting end and the ending end.

4. The refrigerator of claim 3, wherein the starting end extends horizontally to the slope portion.

5. The refrigerator of claim 3, wherein the ending end extends horizontally to the slope portion.

6. The refrigerator of claim 3, wherein the slope portion slantingly extends upward or downward in the pull-out direction of the storeroom.

7. The refrigerator of claim 3, wherein the slope portion is curved with gradually changing slope angles.

8. The refrigerator of claim 3, wherein the guide comprises a groove extending from the starting end to the ending end, and wherein the guidee is arranged to slide within the groove.

9. The refrigerator of claim 1, wherein the slide device further comprises an X link preventing the storeroom from swaying forward or backward when the storeroom is being lifted.

10. The refrigerator of claim 1, wherein the arm member is arranged to be pulled out from the main body along with the storeroom and sliding and turning when being pulled out from the main body, and wherein the arm member is arranged to turn to lift the storeroom.

11. The refrigerator of claim 1, wherein a distance from the effort portion to the fulcrum portion is longer than a distance from the load portion to the fulcrum portion.

12. The refrigerator of claim 1, further comprising:

an X link assisting the storeroom to be lifted by preventing the storeroom from swaying forward or backward, wherein the load portion is connected to a crossing point of the X link.

13. The refrigerator of claim 12, wherein the arm member further comprises a slit allowing the load portion to slide.

14. The refrigerator of claim 1, wherein the storeroom further comprises a slit connected to the load portion, and wherein the load portion is formed to be slidable within the slit.

15. The refrigerator of claim 1, wherein the load portion is lifted or falls along with the storeroom while rotating around the fulcrum portion during rotation of the effort portion.

16. The refrigerator of claim 1, wherein a slit is formed on the supporting frame to allow rotation of the load portion, and wherein the load portion slides within the slit.

17. The refrigerator of claim 1, wherein the load portion is coupled to an outer surface of the storeroom right under or right above the center of the storeroom.

* * * * *